US011342113B2

(12) United States Patent
Hirabayashi et al.

(10) Patent No.: US 11,342,113 B2
(45) Date of Patent: May 24, 2022

(54) REACTOR AND METHOD FOR MANUFACTURING REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Tatsuo Hirabayashi, Mie (JP); Takashi Misaki, Mie (JP); Seiji Shitama, Mie (JP); Shinichiro Yamamoto, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 802 days.

(21) Appl. No.: 16/307,261

(22) PCT Filed: Jun. 7, 2017

(86) PCT No.: PCT/JP2017/021202
§ 371 (c)(1),
(2) Date: Dec. 5, 2018

(87) PCT Pub. No.: WO2017/213196
PCT Pub. Date: Dec. 14, 2017

(65) Prior Publication Data

US 2020/0312542 A1 Oct. 1, 2020

(30) Foreign Application Priority Data

Jun. 10, 2016 (JP) ..... JP2016-116429
Feb. 15, 2017 (JP) ..... JP2017-026481

(51) Int. Cl.
*H01F 38/00* (2006.01)
*H01F 37/00* (2006.01)
(Continued)

(52) U.S. Cl.
CPC ..... *H01F 37/00* (2013.01); *H01F 27/02* (2013.01); *H01F 27/255* (2013.01); *H01F 27/30* (2013.01); *H01F 41/02* (2013.01)

(58) Field of Classification Search
USPC ..... 336/90, 65, 212, 221, 178, 210, 180
See application file for complete search history.

(56) References Cited

U.S. PATENT DOCUMENTS

2013/0038415 A1* 2/2013 Ooishi ..... H01F 37/00 336/61
2015/0365015 A1* 12/2015 Ito ..... H01F 37/00 363/131
2016/0343490 A1* 11/2016 Maeno ..... H01F 27/306

FOREIGN PATENT DOCUMENTS

JP 2003-257756 A 9/2003
JP 2006-319312 A 11/2006
(Continued)

OTHER PUBLICATIONS

International Search Report, Application No. PCT/JP2017/021202 dated Sep. 5, 2017.

*Primary Examiner* — Shawki S Ismail
*Assistant Examiner* — Kazi S Hossain
(74) *Attorney, Agent, or Firm* — Honigman LLP

(57) ABSTRACT

A reactor including: a coil having a winding portion; a magnetic core having a plurality of core pieces; and an inner interposed member interposed between the winding portion and an inner core portion of the magnetic core. An inner resin portion fills an internal space of the winding portion, the inner interposed member includes core holding portions holding the core pieces to be decentered relative to the inner interposed member when seen in the axial direction of the winding portion, a separation distance between the inner circumferential surface of the winding portion and the outer circumferential surface of the inner interposed member on a
(Continued)

displacement direction side is longer than a separation distance between the inner circumferential surface of the winding portion and the outer circumferential surface of the inner interposed member on the side that is opposite the displacement direction side.

10 Claims, 11 Drawing Sheets

(51) Int. Cl.

| | |
|---|---|
| ***H01F 41/02*** | (2006.01) |
| ***H01F 27/02*** | (2006.01) |
| ***H01F 27/30*** | (2006.01) |
| ***H01F 27/255*** | (2006.01) |

(56) References Cited

FOREIGN PATENT DOCUMENTS

| | | | |
|---|---|---|---|
| JP | 2013-211515 | A | 10/2013 |
| JP | 2013-222865 | A | 10/2013 |
| JP | 2015-090912 | A | 5/2015 |
| JP | 2015-126142 | A | 7/2015 |

* cited by examiner

REACTOR AND METHOD FOR MANUFACTURING REACTOR

CROSS-REFERENCE TO RELATED APPLICATIONS

This application is the U.S. national stage of PCT/JP2017/021202 filed Jun. 7, 2017, which claims priority of Japanese Patent Application No. JP 2016-116429 filed Jun. 10, 2016 and Japanese Patent Application No. JP 2017-026481 filed Feb. 15, 2017.

TECHNICAL FIELD

The present disclosure relates to a reactor and a method for manufacturing a reactor.

BACKGROUND

JP 2013-128084A discloses a rector including: a coil that includes a winding portion formed by winding a winding wire; and a magnetic core that forms a closed magnetic circuit. The reactor is used as a component of a converter of a hybrid vehicle, for example. The magnetic core can be divided into an inner core portion that is located inside the winding portion, and an outer core portion that is located outside the winding portion. The inner core portion is constituted by a plurality of core pieces that are insulated from each other, and the outer circumferential surface of each core piece and the inner circumferential surface of the winding portion of the coil are insulated from each other by a tubular portion (an inner interposed member) of an insulator.

SUMMARY

A reactor according to the present disclosure includes a coil that includes a winding portion and a magnetic core that includes an inner core portion located inside the winding portion and an outer core portion located outside the winding portion. An inner interposed member is interposed between the inner circumferential surface of the winding portion and the outer circumferential surface of the inner core portion. The inner core portion includes a plurality of core pieces that are separate from each other. The reactor further includes an inner resin portion that fills a gap between the inner circumferential surface of the winding portion and the outer circumferential surface of the inner core portion. The inner interposed member is provided with core holding portions that hold the core pieces at positions that are decentered relative to the inner interposed member when seen in the axial direction of the winding portion. When a direction from the center point of the inner interposed member to the center points of the core pieces seen in the axial direction of the winding portion is defined as a displacement direction, a separation distance between the inner circumferential surfaces of the winding portion and the outer circumferential surface of the inner interposed member on the displacement direction side is longer than a separation distance between the inner circumferential surface of the winding portion and the outer circumferential surface of the inner interposed member on the side that is opposite the displacement direction side.

A reactor manufacturing method according to the present disclosure includes a step of attaching a magnetic core to a coil that includes a winding portion and a step of filling an internal space of the winding portion with resin, wherein the reactor is the reactor according to the present disclosure. A first assembly in which the core pieces are held by the inner interposed member is disposed in the internal space of the winding portion, and the winding portion is filled with the resin from a displacement direction-side position in an opening portion of an end surface of the winding portion in the axial direction of the winding portion, and thus the first assembly is displaced in a direction that is opposite to the displacement direction.

DETAILED DESCRIPTION OF PREFERRED EMBODIMENTS

Figure 1:
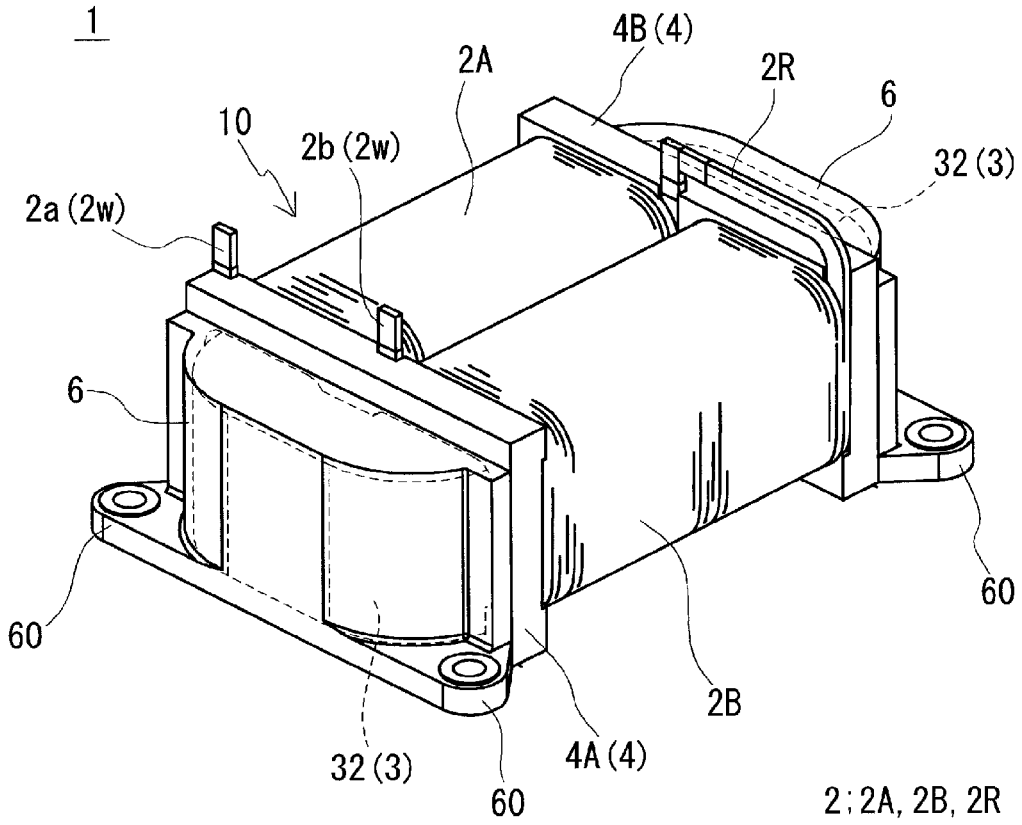
FIG. 1 is a perspective view of a reactor according to a first embodiment.

Problem to be Solved by Present Disclosure

When the internal space of a winding portion is filled with resin in order to integrate the winding portion and an inner core portion into one piece, the center point of the winding portion and the center point of the inner core portion are easily displaced from each other, and there is the risk of resin that is located between the inner circumferential surface of the winding portion and the outer circumferential surface of the inner core portion having a non-uniform thickness. If the thickness of resin is insufficient, there is the risk of a portion with an insufficient thickness being damaged due to vibrations occurring during the use of the reactor.

Therefore, one objective of the present disclosure is to provide a reactor in which variation in the thickness of resin that is located between the inner circumferential surface of the winding portion and the outer circumferential surface of the inner core portion is small. Also, another objective of the present disclosure is to provide a reactor manufacturing method for manufacturing a reactor in which variation in the thickness of resin that is located between the inner circumferential surface of the winding portion and the outer circumferential surface of the inner core portion is small.

Advantageous Effects of Present Disclosure

A reactor according to the present disclosure is a reactor in which variation in the thickness of resin located between the inner circumferential surface of the winding portion and the outer circumferential surface of the inner core portion is small.

A reactor manufacturing method according to the present disclosure is capable of manufacturing a reactor in which variation in the thickness of resin located between the inner circumferential surface of the winding portion and the outer circumferential surface of the inner core portion is small.

DESCRIPTION OF EMBODIMENTS OF PRESENT DISCLOSURE

First, the following lists up and describes embodiments of the present disclosure.

1. A reactor according to an embodiment is a reactor including: a coil that includes a winding portion; a magnetic core that includes an inner core portion located inside the winding portion and an outer core portion located outside the winding portion; and an inner interposed member that is interposed between the inner circumferential surface of the winding portion and the outer circumferential surface of the inner core portion, wherein the inner core portion includes a plurality of core pieces that are separate from each other, the reactor further comprises an inner resin portion that fills a gap between the inner circumferential surface of the winding portion and the outer circumferential surface of the inner core portion, the inner interposed member is provided with core holding portions that hold the core pieces at positions that are decentered relative to the inner interposed member when seen in the axial direction of the winding portion, and when a direction from the center point of the inner interposed member to the center points of the core pieces seen in the axial direction of the winding portion is defined as a displacement direction, a separation distance between the inner circumferential surfaces of the winding portion and the outer circumferential surface of the inner interposed member on the displacement direction side is longer than a separation distance between the inner circumferential surface of the winding portion and the outer circumferential surface of the inner interposed member on the side that is opposite the displacement direction side.

In the reactor with the above-described configuration, the core pieces located in the winding portions of the coil are held by the inner interposed member. The core pieces are held by the core holding portions of the inner interposed member, at positions that are decentered relative to the inner interposed member, and the inner interposed member that holds the core pieces is displaced in the direction that is opposite to the displacement direction of the core pieces in the winding portion. That is, the center points of the core pieces (the center point of the inner core portion) seen in the axial direction of the winding portion are positioned close to the center point of the winding portion. Therefore, variation in the thickness of the inner resin portion located between the inner circumferential surface of the winding portion and an exposed portion of the outer circumferential surface of the inner core portion that is not covered by the inner interposed member is small, and the inner resin portion is less likely to be damaged due to, for example, vibrations occurring during the use of the reactor.

In the reactor according to the embodiment, the inner interposed member may include a plurality of divisional pieces that are arranged in the axial direction of the winding portion and are separate from each other, and each divisional piece may include a frame portion that houses an end portion, in the axial direction, of a core piece, and the core holding portions that are provided integrally with the frame portion.

If the inner interposed member is constituted by a plurality of divisional pieces, it is easier to attach the core pieces to the inner interposed member. Also, the shape of the inner interposed member can be simpler than when the inner interposed member is configured as an integrated piece. Therefore, it is easier to manufacture the inner interposed member.

In the reactor according to the embodiment, each core piece may have a rectangular parallelepiped shape with four coil-facing surfaces that face the inner circumferential surface of the winding portion, the inner interposed member may be provided with core holding portions that support corner portions of two coil-facing surfaces that are adjacent to each other, and the thickness of a core holding portion located on the displacement direction side may be smaller than the thickness of a core holding portion on the side that is opposite the displacement direction side.

By holding corner portions of the core pieces by using the core holding portions, it is possible to fix the position of the core pieces relative to the inner interposed member. Therefore, when resin that constitutes the inner resin portion is injected in order to manufacture the reactor, the positions of the core pieces relative to the inner interposed member seen in the axial direction of the winding portion do not change, and the center points of the core pieces (the inner core portion) can be positioned close to the center point of the winding portion.

The reactor according to the embodiment may further include: an end surface interposed member that is interposed between an end surface of the winding portion in the axial direction and the outer core portion, wherein the end surface interposed member may be provided with a resin filling hole that is used to fill an internal space of the winding portion with resin that constitutes the inner resin portion, from the outer core portion side, and the resin filling hole may be located on the displacement direction side when the end surface interposed member is seen in the axial direction of the winding portion.

If the end surface interposed member is used, it is easier to determine the relative positions of the inner core portion and the outer core portion when manufacturing the reactor. Also, if a resin filling hole is formed in the end surface interposed member, it is easier to fill the internal space of the winding portion with resin when manufacturing the reactor. Furthermore, if the resin filling hole is formed on the displacement direction side of the core piece, when the reactor is manufactured, the assembly constituted by the core pieces and the inner interposed member is pressed in a direction that is opposite to the displacement direction of the core pieces, due to pressure from resin when the winding portion is filled with resin via the resin filling hole. As a result, the assembly in the winding portion is moved in a direction that is opposite to the displacement direction of the core pieces. However, the core pieces in the assembly are displaced in the displacement direction relative to the inner interposed member, and therefore, the center points of the core pieces constituting the inner core portion are positioned close to the center point of the winding portion.

The reactor according to the embodiment in which the end surface interposed member is provided may further include: an outer resin portion that integrates the outer core portion with the end surface interposed member, and the outer resin portion and the inner resin portion may be connected to each other via the resin filling hole.

Since the outer resin portion and the inner resin portion may be connected to each other via the resin filling hole, both resin portions can be formed by performing molding once. In other words, despite being provided with the outer resin portion in addition to the inner resin portion, the reactor with this configuration can be obtained by performing resin molding only once, and thus productivity is excellent.

In the reactor according to the embodiment, the inner core portion may include the plurality of core pieces and the inner resin portion that fills gaps between core pieces that are adjacent to each other in the axial direction of the winding portion.

The inner resin portion that fills gaps between the core pieces serves as a resin gap portion that controls the magnetic properties of the magnetic core. In other words, a reactor with this configuration does not require gap members that are made of another material such as alumina. Since gap members are unnecessary, productivity is excellent.

In the reactor according to the embodiment, the coil may include an integration resin that is separate from the inner resin portion and integrates turns of the winding portion into one piece.

With the above-described configuration, it is possible to improve the productivity of the reactor. This is because, if the turns of the winding portions are integrated into one piece, the winding portion is less likely to bend, and when manufacturing the reactor, it is easier to dispose the magnetic core in the internal space of the winding portion. Also, if the turns of the winding portion are integrated into one piece, it is less likely that large gaps are formed between the turns, and when manufacturing the reactor, it is less likely that the resin filled into the internal space of the winding portion leaks out of the gaps between the turns. As a result, it is less likely that a large empty space is formed in the internal space of the winding portion.

In the reactor according to the embodiment, the inner interposed member may be provided with a direction determining portion that determines a direction in which the inner interposed member is attached to the winding portion.

In the reactor according to the embodiment in which core pieces are held at positions that are decentered relative to the inner interposed member, there is an assembly direction, which is a direction in which the inner interposed member is attached to the winding portion. Therefore, in a case where a coil that includes a pair of winding portions is used, if a portion of an inner interposed member that is to be located on the outer side of the pair of winding portions arranged side by side is located on the inner side of the pair of winding portions arranged side by side (a position between the winding portions), the displacement directions of the core pieces relative to the inner interposed members will be different from the desired directions, and the center points of the core pieces cannot be located at the center points of the winding portions. It is possible to avoid such a problem by providing direction determining portions on the inner interposed members. The direction determining portions may be configured as marks such as text (characters) or graphical symbols that are provided at positions on the inner interposed members that can be easily seen, or recesses or protrusions.

In the reactor according to the embodiment in which the end surface interposed member is provided with the direction determining portion, the direction determining portion may be configured as a protrusion or a recess provided on/in the inner circumferential surface of the inner interposed member, and each core piece may be provided with an engaging portion that is a protrusion or a recess that engages with the direction determining portion.

Due to a recess and a protrusion engaging with each other, it is possible to determine the direction in which the inner interposed member is attached to the winding portion, and make it easier to attach the core pieces and the inner interposed member to each other.

A reactor manufacturing method according to an embodiment is: a reactor manufacturing method comprising: an assembly step that is a step of attaching a magnetic core to a coil that includes a winding portion; and a filling step that is a step of filling an internal space of the winding portion with resin, wherein the reactor is the reactor according to the embodiment, in the assembly step, a first assembly in which the core pieces are held by the inner interposed member is disposed in the internal space of the winding portion, and in the filling step, the winding portion is filled with the resin from a displacement direction-side position in an opening portion of an end surface of the winding portion in the axial direction of the winding portion, and thus the first assembly is displaced in a direction that is opposite to the displacement direction.

According to the above-described reactor manufacturing method, in the assembly step, the core pieces that constitute the inner core portion are held by the inner interposed member, and the first assembly constituted by the core pieces and the inner interposed member is disposed in the internal space of the winding portion of the coil. The core pieces are decentered relative to the inner interposed member. Therefore, in the filling step, when resin is injected from a displacement direction-side position in an opening portion of the winding portion and the first assembly is moved in a direction that is opposite to the displacement direction due to filling pressure of the resin, the center points of the core pieces seen in the axial direction of the winding portion are positioned very close to the center point of the winding portion. As a result, the distance between the inner circumferential surface of the winding portion and the outer circumferential surfaces of the core pieces (the inner core portion) are substantially uniform along the circumference, and variation in the thickness of the resin located between the inner circumferential surface of the winding portion and the outer circumferential surface of the inner core portion is small.

DETAILS OF EMBODIMENTS OF PRESENT DISCLOSURE

The following describes embodiments of a reactor according to the present disclosure with reference to drawings. Elements having the same name are denoted by the same reference numerals throughout the drawings. Note that the present disclosure is not limited to configurations shown in the embodiments, and is specified by the scope of claims. All changes that come within the meaning and range of equivalency of the claims are intended to be embraced therein.

First Embodiment

The first embodiment describes a configuration of a reactor 1 with reference to FIGS. 1 to 8. The reactor 1 shown in FIG. 1 includes a combined body 10 formed by combining a coil 2, a magnetic core 3, and an insulative interposed member 4. The combined body 10 also includes inner resin portions 5 (see FIG. 2) that are located inside winding portions 2A and 2B of the coil 2, and outer resin portions 6 that cover outer core portions 32 that are included in the magnetic core 3. One feature of the reactor 1 lies in how the magnetic core 3 is held in the winding portions 2A and 2B. The following describes the components of the reactor 1 in detail, and then describes how the magnetic core 3 is held in the winding portions 2A and 2B. Finally, a method for manufacturing the reactor 1 will be described.

Combined Body

Figure 3:
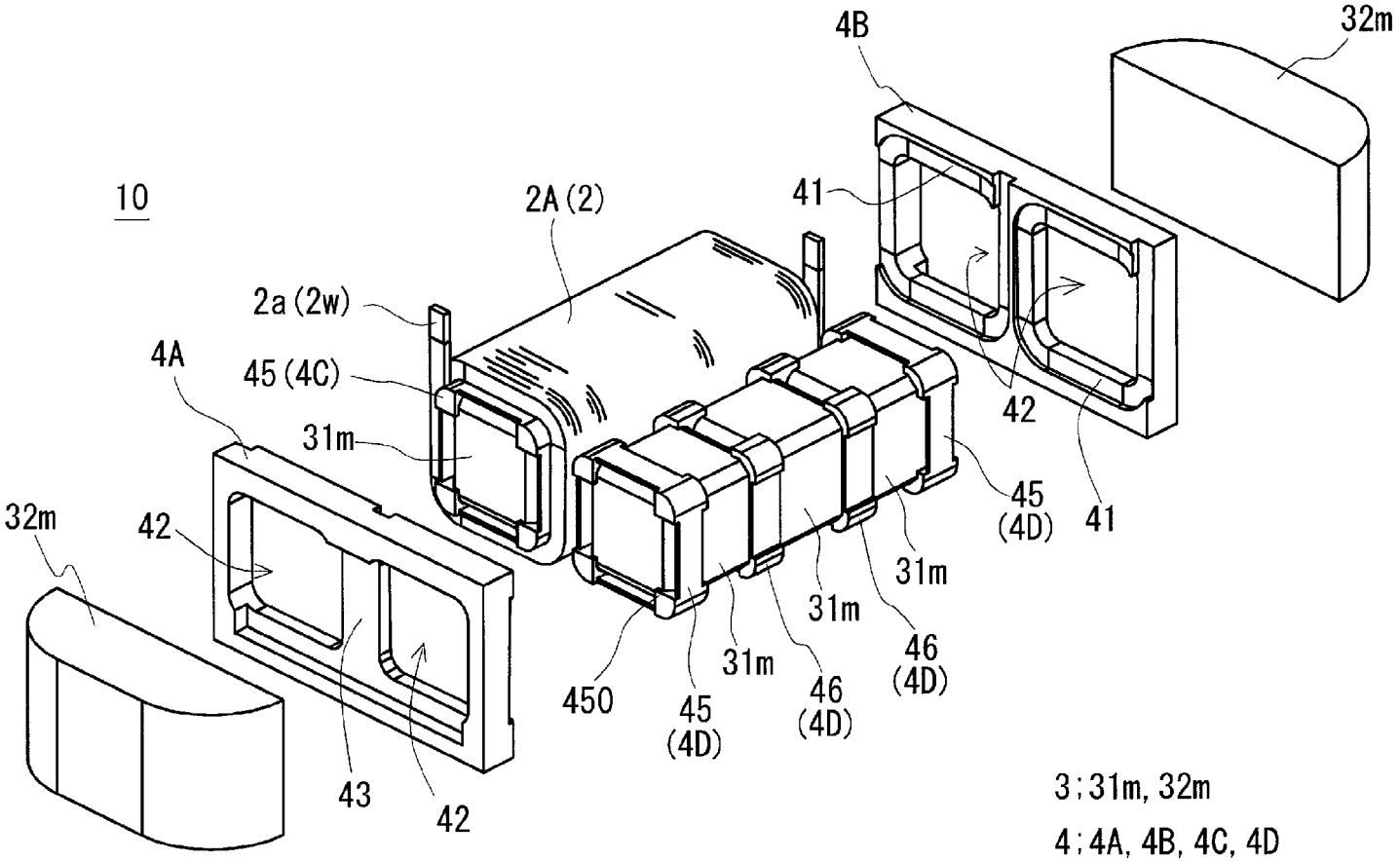
FIG. 3 is an exploded perspective view of a portion of a combined body included in the reactor according to the first embodiment.

The combined body 10 will be described mainly with reference to FIG. 3. In FIG. 3, some components of the combined body 10 (e.g. the winding portion 2B shown in FIG. 1) are omitted.

Coil

The coil 2 according to the present embodiment includes a pair of winding portions 2A and 2B, and a coupling portion 2R that couples the winding portions 2A and 2B to each other (see FIG. 1 for the winding portion 2B and the coupling portion 2R). The winding portions 2A and 2B each have a hollow tubular shape with the same number of turns wound in the same direction, and are arranged side by side such that their axial directions are parallel with each other. In this example, the coil 2 is formed by coupling the winding portions 2A and 2B, which have been manufactured using separate winding wires. However, the coil 2 may also be manufactured using a single winding wire.

The winding portions 2A and 2B according to the present embodiment each have a rectangular tube shape. Winding portions 2A and 2B that have a rectangular tube shape are winding portions that have an end surface that has a rectangular shape (which may be a square shape) with rounded corners. As a matter of course, the winding portions 2A and 2B may also have a cylindrical shape. Winding portions that each have a cylindrical shape are winding portions that have an end surface that has a closed curved surface shape (such as an elliptical shape, a perfect circular shape, or a race track shape).

The coil 2 including the winding portions 2A and 2B may be made of a coated wire in which the outer circumferential surface of a conductor such as a flat wire or a round wire that is made of a conductive material such as copper, aluminum, magnesium, or an alloy thereof is coated with an insulative coating that is made of an insulative material. In the present embodiment, the winding portions 2A and 2B are formed through edgewise-winding of a coated flat wire that includes a conductor that is made of a copper flat wire (a winding wire 2*w*) and an insulative coating that is made of enamel (typically polyamide imide).

Two end portions 2*a* and 2*b* of the coil 2 are drawn out of the winding portions 2A and 2B, and are connected to a terminal member, which is not shown. The insulative coating, which is made of enamel or the like, has been peeled off from the end portions 2*a* and 2*b*. An external device such as a power supply for supplying power to the coil 2 is connected via the terminal member.

Integration Resin

It is preferable that the coil 2 with the above-described configuration is formed as an integrated member, using resin. In the case of this example, the winding portions 2A and 2B of the coil 2 are formed as integrated members, using an integration resin 20 (see FIG. 2). The integration resin 20 in this example is formed by fusing a coating layer of a heat-fusing resin that is formed on the outer circumferential surface of a winding wire 2*w* (the outer circumferential surface of the insulative coating that is made of enamel or the like), and is very thin. Therefore, despite the winding portions 2A and 2B being formed as integrated members using an integration resin 20, the shape of, and the boundary between, the turns of the winding portions 2A and 2B can be seen from the outside. Examples of the material of the integration resin 20 include a resin that can be thermally fused, e.g. a thermosetting resin such as an epoxy resin, a silicone resin, and unsaturated polyester.

Figure 2:
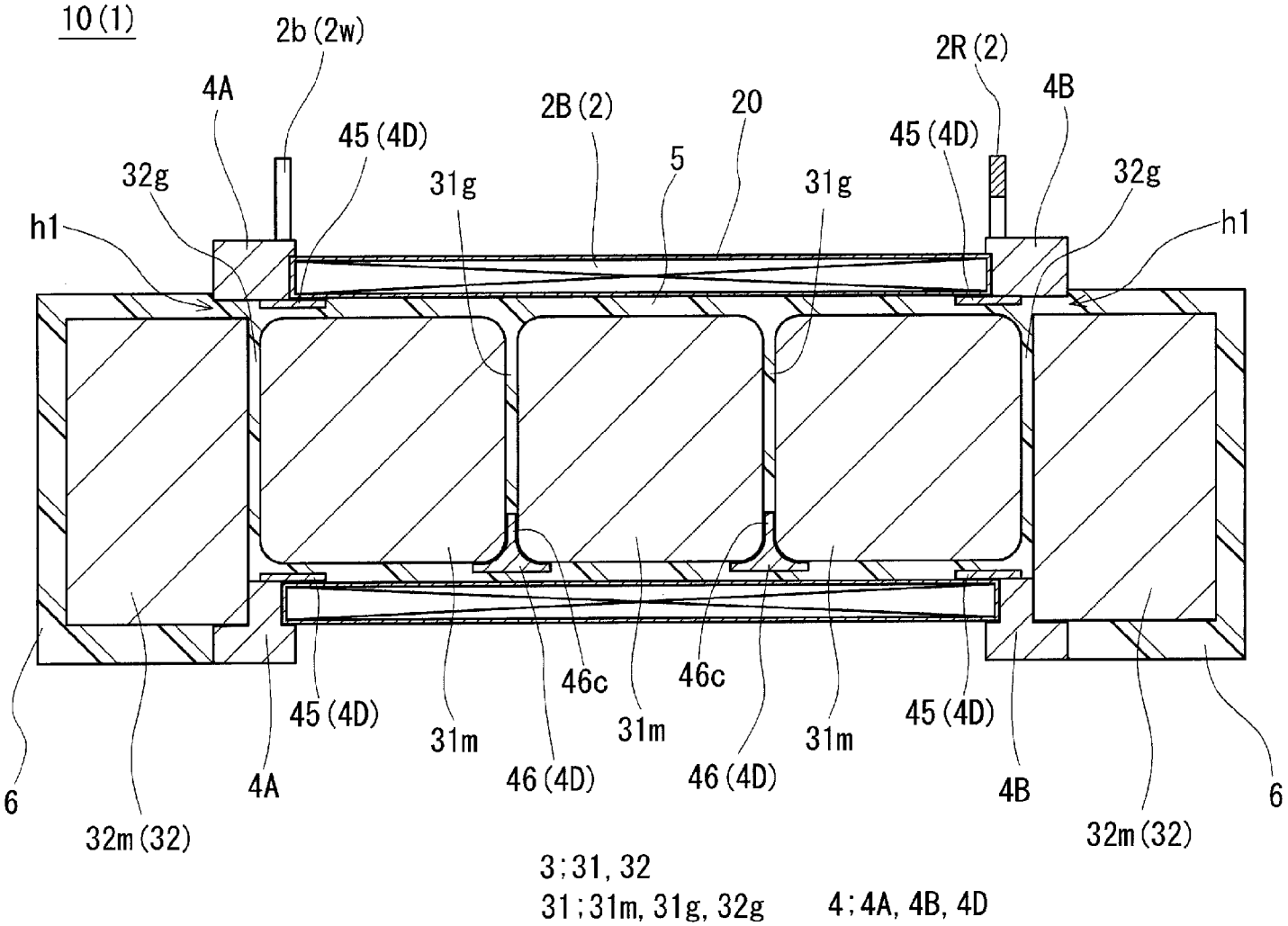
FIG. 2 is a longitudinal cross-sectional view of the reactor shown in FIG. 1, through a winding portion on the right of the drawing sheet.

Although the integration resin 20 in FIG. 2 is exaggerated, it is very thin in reality. The integration resin 20 integrates the turns that constitute the winding portion 2B into one piece, and restricts the winding portion 2B from expanding or contracting in the axial direction (the same applies to the winding portion 2A). In this example, the integration resin 20 is formed by fusing a heat-fusing resin formed on a winding wire 2*w*, and therefore the integration resin 20 uniformly fills the gaps between the turns. The thickness of the integration resin 20 between turns is approximately twice the thickness of a heat-fusing resin formed on the surface of the winding wire 2*w* that has not been wound, and is specifically at least 20 μm and at most 2 mm, for example. By setting the thickness to be large, it is possible to firmly integrate the turns into one piece, and by setting the thickness to be small, it is possible to prevent the winding portion 2B from being too long in the axial direction.

The thickness of the integration resin 20 on the outer circumferential surface and the inner circumferential surface of the winding portion 2B is approximately the same as the thickness of the heat-fusing resin formed on the surface of the winding wire 2*w* that has not been wound, and the thickness is at least 10 μm and at most 1 mm, for example. By setting the aforementioned thickness to be at least 10 μm, it is possible to firmly integrate the turns of the winding portions 2A and 2B into one piece so that the turns do not become separated from each other. By setting the aforementioned thickness to be no greater than 1 mm, it is possible to prevent the integration resin 20 from degrading the heat dissipation properties of the winding portion 2B.

Here, each of the winding portions 2A and 2B of the coil 2 shown in FIG. 1, which has a rectangular tube shape, includes four corner portions formed by bending a winding wire 2*w*, and flat portions where a winding wire 2*w* is not bent. In this example, in each of the winding portions 2A and 2B, turns are integrated into one piece in both the corner portions and the flat portions, using an integration resin 20 (see FIG. 2). However, it is also possible to employ a configuration in which turns are integrated into one piece only in some portions of the winding portions 2A and 2B, e.g. only in the corner portions, using an integration resin 20.

In the corner portions of the winding portions 2A and 2B, which are formed through edgewise-winding of a winding wire 2*w*, the inner side of a bend is likely to be thicker than the outer side of the bend. If this is the case, in the flat portions of the winding portions 2A and 2B, a heat-fusing resin is present on the outer circumferential surface of a winding wire 2*w*, but, in some cases, turns are not integrated into one piece and become separated from each other. If gaps in the flat portions are sufficiently small, resin filled into the internal spaces of the winding portions 2A and 2B cannot pass through the gaps in the flat portions due to the effect of surface tension.

Magnetic Core

The magnetic core 3 is formed by combining a plurality of core pieces 31*m* and 32*m*, which can be classified into inner core portions 31 and outer core portions 32 for the sake of convenience (see FIGS. 2 and 3 in combination).

Inner Core Portions

As shown in FIG. 2, an inner core portion 31 is located inside the winding portion 2B of the coil 2 (the same applies to the winding portion 2A). Here, the inner core portion 31 is a portion of the magnetic core 3 extending in the axial direction of the winding portions 2A and 2B of the coil 2. In this example, the two end portions of a portion of the magnetic core 3 extending in the axial direction of the winding portion 2B protrude outward from the winding portion 2B, and these protruding portions are also included in the inner core portion 31.

Figure 5:
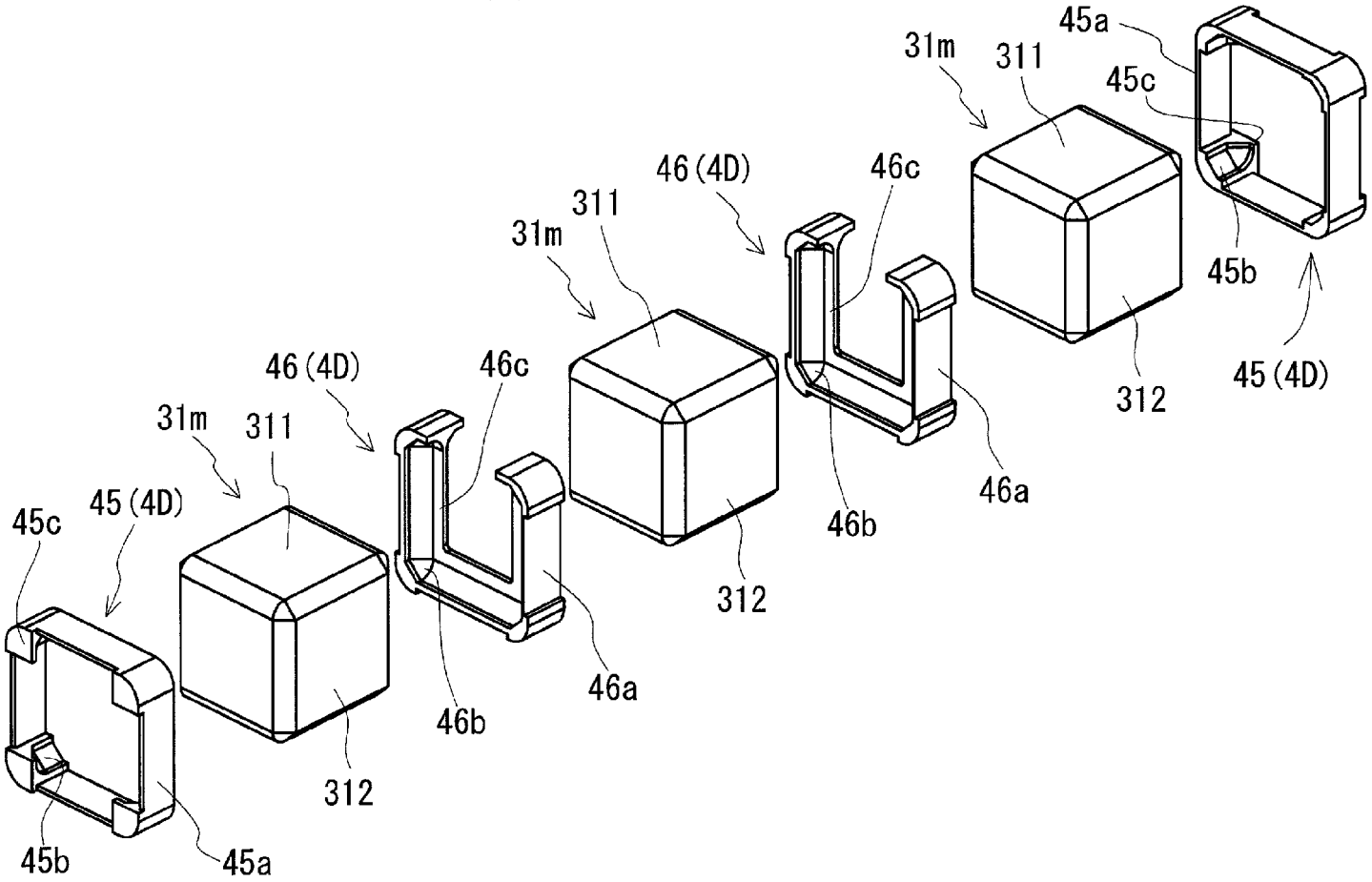
FIG. 5 is an exploded perspective view of core pieces that constitute an inner core portion and core pieces that constitute an inner interposed member.

Each inner core portion 31 in this example is constituted by three core pieces 31*m*, gap portions 31*g* that are each formed between core pieces 31*m*, and gap portions 32*g* that are each formed between a core piece 31*m* and a core piece 32*m* described below. The gap portions 31*g* and 32*g* in this example are formed using an inner resin portion 5 described below. The inner core portions 31 have a shape that matches the internal shape of the winding portion 2A (2B), which is a substantially rectangular parallelepiped shape in this example as shown in FIG. 5.

Outer Core Portions

As shown in FIGS. 2 and 3, the outer core portions 32 are portions that are located outside the winding portions 2A and 2B, and have a shape that connects end portions of the pair of inner core portions 31. Each outer core portion 32 in this example is constituted by a core piece 32*m* that is columnar and has substantially domed upper and lower surfaces.

The above-described core pieces 31*m* and 32*m* are powder compacts formed through pressure forming, using a raw material powder that contains soft magnetic powder. Soft magnetic powder is an aggregation of magnetic particles that include particles of an iron-group metal such as iron, an alloy thereof (an Fe—Si alloy, an Fe—Si—Al alloy, an Fe—Ni alloy, etc.), or the like. The raw material powder may contain a lubricant. The core pieces 31*m* and 32*m* may be formed as compacts that are made of a composite material that contains soft magnetic powder and resin, unlike in this example. The soft magnetic powder and the resin contained in the composite material may be the same as the soft magnetic powder and the resin that can be used in the powder compact. Insulative coatings that are made of a phosphate or the like may be formed on the surfaces of the magnetic particles. It is possible that either the core pieces 31*m* (the inner core portions 31) or the core pieces 32*m* (the outer core portions 32) are powder compacts, and the others are compacts that are made of a composite material. Alternatively, the core pieces 31*m* and 32*m* may be formed as laminated steel plates.

Insulative Interposed Member

As shown in FIGS. 2 and 3, the insulative interposed member 4 is a member that ensures insulation between the coil 2 and the magnetic core 3, and is constituted by end surface interposed members 4A and 4B and inner interposed members 4C and 4D. The insulative interposed member 4 can be formed using a thermoplastic resin, such as a polyphenylene sulfide (PPS) resin, a polytetrafluoroethylene (PTFE) resin, a liquid crystal polymer (LCP), a polyamide (PA) resin such as nylon 6 or nylon 66, a polybutylene terephthalate (PBT) resin, or a acrylonitrile butadiene styrene (ABS) resin, for example. Alternatively, the insulative interposed member 4 may be formed using a thermosetting resin such as an unsaturated polyester resin, an epoxy resin, a urethane resin, or a silicone resin, for example. It is also possible to improve the heat dissipation properties of the insulative interposed member 4 by adding a ceramic filler to the aforementioned resins. Non-magnetic powder of alumina or silica, for example, may be used as the ceramic filler.

End Surface Interposed Members

The end surface interposed members 4A and 4B will be described mainly with reference to FIG. 3. The end surface interposed members 4A and 4B in this example have the same shape.

Two turn-housing portions 41 that house end portions of the winding portions 2A and 2B in the axial direction are formed in the coil 2-side surface of each of the end surface interposed members 4A and 4B (see the end surface interposed member 4B). The turn-housing portions 41 are formed so that end surfaces of the winding portions 2A and 2B in the axial direction can be entirely brought into surface contact with the end surface interposed members 4A and 4B. More specifically, the turn-housing portions 41 are grooves that each have a square loop shape surrounding a core insertion hole 42 described below, and the depth of these grooves gradually changes according to the shape of the end surfaces of the winding portions 2A and 2B. The right edges of the turn-housing portions 41 reach the upper ends of the end surface interposed members 4A and 4B, so that winding wires that constitute the winding portions 2A and 2B can be drawn upward. Due to the turn-housing portions 41 bringing end surfaces of the winding portions 2A and 2B in the axial direction into surface contact with the end surface interposed members 4A and 4B, resin is prevented from leaking from the contact areas.

Each of the end surface interposed members 4A and 4B is also provided with a pair of core insertion holes 42 and a fitting portion 43 (see the end surface interposed member 4A) in addition to the above-described turn-housing portions 41. The core insertion holes 42 are holes into which an assembly including the inner interposed members 4C and 4D and the core pieces 31*m* is to be fitted. The fitting portion 43 is a recessed portion into which a core piece 32*m*, which constitutes an outer core portion 32, is to be fitted. The assembly fitted into the core insertion holes 42 are in contact with a core piece 32*m*.

Figure 4:
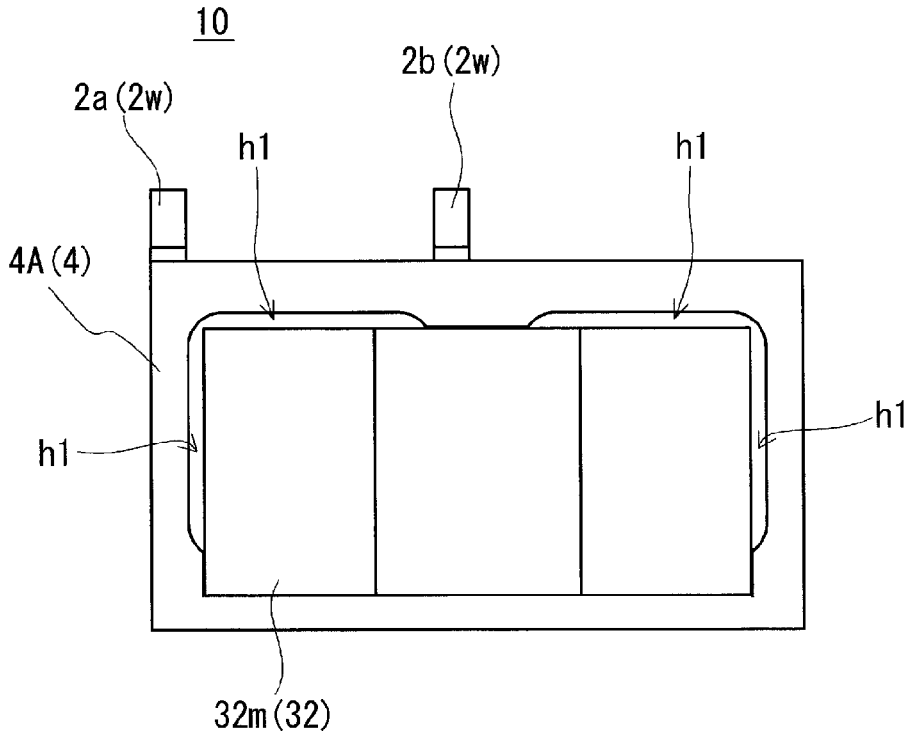
FIG. 4 is a schematic view of the combined body included in the reactor according to the first embodiment, seen from an outer side of an outer core portion.

An outer portion and an upper portion of each of the aforementioned core insertion holes 42 are recessed outward in a radial direction (see the end surface interposed member 4B). As shown in FIG. 4, when a core piece 32*m* is fitted into the fitting portion 43 (see FIG. 3) of the end surface interposed member 4A, resin filling holes h1 are formed in this recessed portion, at side edge positions and upper edge positions of the core piece 32*m*. The resin filling holes h1 penetrate through the end surface interposed member 4A in the thickness direction thereof, from the outer core portion 32-side (the core piece 32*m*-side), which is the front side of the drawing sheet, toward the end surfaces of the winding portions 2A and 2B (see FIG. 1) in the axial direction, which is on the back side of the drawing sheet. The resin filling holes h1 are in communication with space between the inner circumferential surfaces of the winding portions 2A and 2B and the outer circumferential surfaces of the inner core portions 31 (the core pieces 31*m*) on the back side of the drawing sheet (see FIG. 2 also).

Inner Interposed Members

The inner interposed members 4C and 4D have the same configuration. Therefore, the following describes the inner interposed member 4D as a representative. As shown in FIGS. 3 and 5, the inner interposed member 4D in this example is constituted by a plurality of divisional pieces. The divisional pieces can be classified into end portion divisional pieces 45 that are each interposed between a core piece 32*m* and a core piece 31*m*, and intermediate divisional pieces 46 that are interposed between core pieces 31*m* that are adjacent to each other. The divisional pieces 45 and 46 separate the core pieces 31*m* that are adjacent to each other, from each other, and separate the outer circumferential surfaces of the core pieces 31*m* (coil-facing surfaces 311 to 314, which will be described later with reference to FIGS. 6 and 7) and the inner circumferential surface of the winding portion 2B (see FIG. 1) from each other. Large portions of the outer circumferential surfaces of the core pieces 31*m* are exposed to the outside without being covered by the divisional pieces 45 and 46.

As shown in FIG. 5, each end portion divisional piece 45 includes a frame portion 45*a* that has a substantially rectangular frame shape, core holding portions 45*b* that constitute four corner portions of the frame portion 45*a*, and abutting portions 45*c* that are located at positions corresponding to the core holding portions 45*b* and against which a core piece 31*m* abuts. As shown in FIG. 3, the frame portion 45*a* houses an end portion of a core piece 31*m* in the axial direction (which is the same as the axial direction of the winding portion 2B). The core holding portions 45*b* hold the core piece 31*m* that is fitted into the frame portion 45*a*, and position the core piece 31*m* relative to the frame portion 45*a*. The abutting portions 45*c* are interposed between the core piece 31*m* that is fitted into the frame portion 45*a* and a core piece 32*m* shown in FIG. 3 (an outer core portion 32), and form a separating portion that has a predetermined length, between the core pieces 31*m* and 32*m*. As shown in FIG. 2, the inner resin portion 5 fills the separating portions, and thus the gap portions 32*g* are formed. Here, how the core holding portions 45*b* hold the core piece 31*m* is one feature of the reactor 1 in this example, and therefore this feature will be described in detail later.

As shown in FIG. 5, each intermediate divisional piece 46 includes a frame portion 46*a* that is substantially U-shaped, core holding portions 46*b* that constitute four corner portions of the frame portion 46*a*, and an abutting portion 46*c* against which the core pieces 31*m* abut. The abutting portions 46*c* are provided at intermediate positions in the axial direction of the frame portions 46*a*, and each located inside a frame portion 46*a*. Therefore, when the core pieces 31*m* are respectively fitted into a frame portion 46*a* from one side and the other side of the frame portion 46*a*, a separating portion having a predetermined length is formed between the core piece 31*m* on the one side and the core piece 31*m* on the other side. As shown in FIG. 2, the inner resin portion 5 fills the separating portions, and thus the gap portions 31*g* are formed. Here, how the core holding portions 46*b* hold the core piece 31*m* is one feature of the reactor 1 in this example, and therefore this feature will be described in detail later.

Inner Resin Portions

As shown in FIG. 2, the inner resin portion 5 is located inside the winding portion 2B (the same applied to the winding portion 2A, which is not shown), and joins the inner circumferential surface of the winding portion 2B and the outer circumferential surfaces of the core pieces 31*m* (the inner core portions 31) to each other.

The winding portion 2B is integrated into one piece using an integration resin 20, and therefore the inner resin portion 5 is retained in the internal space of the winding portion 2B without reaching from the inner circumferential surface to the outer circumferential surface of the winding portion 2B. Portions of the inner resin portion 5 flow into a gap between core pieces 31*m* and a gap between a core piece 31*m* and a core piece 32*m*, and thus the gap portions 31*g* and 32*g* are formed.

Examples of the inner resin portions 5 include a thermosetting resin such as an epoxy resin, a phenol resin, a silicone resin, or a urethane resin, a thermoplastic resin such as a PPS resin, a PA resin, a polyimide resin, or a fluororesin, a room-temperature setting resin, and a low-temperature setting resin. It is also possible to improve the heat dissipation properties of the inner resin portions 5 by adding a ceramic filler such as alumina or silica to these resins. It is preferable that the inner resin portions 5 are formed using the same material as the end surface interposed members 4A and 4B and the inner interposed members 4C and 4D. By forming these three kinds of members using the same material, it is possible to equalize the coefficient of linear expansion of the three kinds of members, and it is possible to prevent the members from being damaged due to thermal expansion or contraction.

Outer Resin Portions

As shown in FIGS. 1 and 2, the outer resin portions 6 cover the outer circumferential surfaces of the core pieces 32*m* (the outer core portions 32) overall, fix the core pieces 32*m* to the end surface interposed members 4A and 4B, and protect the core pieces 32*m* from an external environment. Here, the lower surfaces of the core pieces 32*m* may be exposed from the outer resin portions 6 to the outside. If this is the case, it is preferable that lower portions of the core pieces 32*m* extend so as to be substantially flush with the lower surfaces of the end surface interposed members 4A and 4B. By bringing the lower surfaces of the core pieces 32*m* into direct contact with an installation surface on which the combined body 10 is to be installed, or by interposing an adhesive or an insulation sheet between the installation surface and the lower surfaces of the core pieces 32*m*, it is possible to improve the heat dissipation properties of the magnetic core 3 including the core pieces 32*m*.

The outer resin portions 6 in this example are provided on end surfaces of the interposed members 4A and 4B on the core pieces 32*m*-side, and do not reach the outer circumferential surfaces of the winding portions 2A and 2B. Considering the function of the outer resin portions 6 of fixing and protecting the core pieces 32*m*, formation ranges in which the outer resin portions 6 are formed are sufficient if they are as large as those shown in the figures, and such formation ranges are preferable in that the amount of resin to be used can be reduced. Of course, the outer resin portions 6 may reach the winding portions 2A and 2B, unlike in the example shown in the figures.

As shown in FIG. 2, the outer resin portions 6 in this example are continuous with the inner resin portions 5 via the resin filling holes h1 in the end surface interposed members 4A and 4B. That is, the outer resin portions 6 and the inner resin portions 5 are formed at the same time using the same resin. It is also possible to separately form the outer resin portions 6 and the inner resin portions 5, unlike in this example.

The outer resin portions 6 can be formed using resin that is the same as resin that can be used to form the inner resin portions 5. If the outer resin portions 6 and the inner resin portions 5 are continuous as in this example, these resin portions are formed using the same resin.

In addition, fixing portions 60 (see FIG. 1) for fixing the combined body 10 to the installation surface (e.g. the bottom surface of a casing) are formed on the outer resin portions 6. For example, fixing portions 60 for fixing the combined body 10 to the installation surface, using bolts, can be formed by embedding collars that are made of highly rigid metal or resin in the outer resin portions 6.

The combined body 10 can be used in the state of being immersed in a liquid refrigerant. Although the liquid refrigerant is not particularly limited, if the reactor 1 is used in a hybrid vehicle, an ATF (Automatic Transmission Fluid) or the like may be used as the liquid refrigerant. In addition, a fluorinated inert liquid such as Fluorinert (registered trademark), a Freon-type refrigerant such as HCFC-123 or HFC-134a, an alcohol-based refrigerant such as methanol or alcohol, or a ketone-based refrigerant such as acetone may also be used as the liquid refrigerant.

How Inner Core Portions are Held in Winding Portions

As described above, one feature of the reactor 1 shown in FIG. 1 lies in how the magnetic core 3 (i.e. the inner core portions 31 in FIG. 3) is held in the winding portions 2A and 2B. Before describing this feature, the following describes how the inner interposed member 4D holds the core pieces 31*m*.

How End Portion Divisional Piece Holds Core Piece

Figure 6:
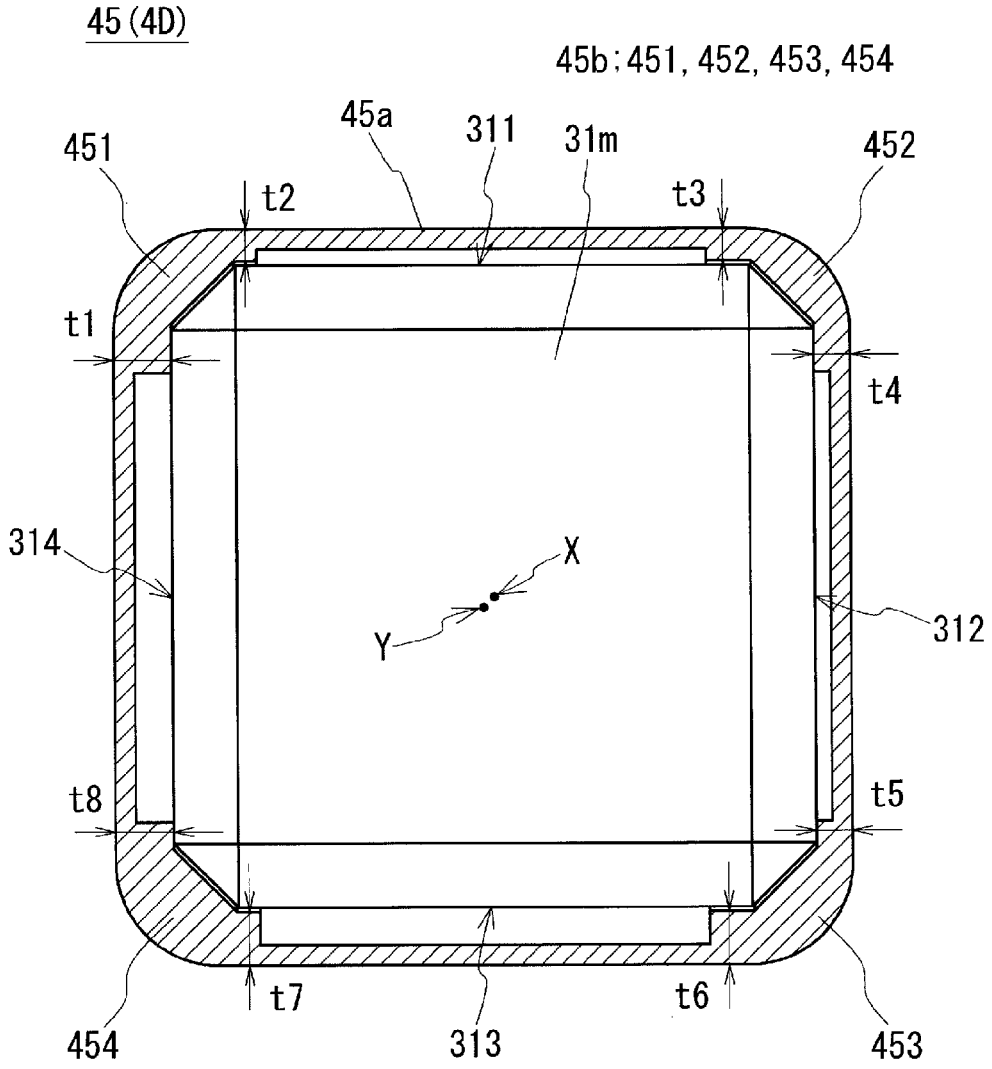
FIG. 6 is a partial cross-sectional view illustrating how a core piece is fitted into an end portion divisional piece of the inner interposed member.

How the core holding portions 45*b* hold a core piece 31*m* will be described with reference to FIG. 6. FIG. 6 is a partial cross-sectional view of the end portion divisional piece 45 on the left in FIG. 5, into which a core piece 31*m* is fitted, and is a view from the end portion divisional piece 45 side. In FIG. 6, the core holding portions 45*b* are assigned reference numerals 451, 452, 453, and 454 in the clockwise direction from the one at the upper left of the drawing sheet. Also, surfaces of the core piece 31*m* out of its six surfaces are assigned reference numerals 311, 312, 313, and 314 in the clockwise direction from the surface on the upper side of the drawing sheet (the surfaces 311 and 312 are also shown in FIG. 5). The surfaces 311 to 314 are coil-facing surfaces that face the inner circumferential surface of the winding portion 2B (FIG. 1).

The core holding portions 451 to 454 are configured as described below. Therefore, the core piece 31*m* held by the core holding portions 451 to 454 is placed at a position that is decentered toward the top right of the drawing sheet relative to the frame portion 45*a*. That is, a center point X of the core piece 31*m*, which is the intersection of the diagonal lines of the rectangle that circumscribes the core piece 31*m*, is placed at a position that is displaced from a center point Y of the end portion divisional piece 45, which is the intersection of the diagonal lines of the rectangle that circumscribes the end portion divisional piece 45. The amount of displacement of the core piece 31*m* in a displacement direction, which is a direction from the center point Y to the center point X (i.e. the distance between the center point X and the center point Y) can be selected as appropriate. For example, the amount of displacement may be at least 0.1 mm and at most 1.5 mm, and more preferably at least 0.15 mm and at most 0.7 mm.

The contour of the cross section of the outer circumferential surface of each of the core holding portions 451 to 454 is constituted by a round portion, which is arc-shaped, and two straight line portions that extend from the ends of the round portion. In this example, one of the straight line portions is orthogonal to the other of the straight line portions.

The contours of the inner circumferential surfaces of the core holding portions 451 to 454 have a shape that matches the contours of the corner portions of the core piece 31*m*.

The core holding portion 451 holds the corner portion between the coil-facing surface 311 and the coil-facing surface 314. A thickness t1 from the coil-facing surface 314 to the outer circumferential surface (a straight line portion) is greater than a thickness t2 from the coil-facing surface 311 to the outer circumferential surface.

The core holding portion 452 holds the corner portion between the coil-facing surface 311 and the coil-facing surface 312. A thickness t3 from the coil-facing surface 311 to the outer circumferential surface is smaller than a thickness t4 from the coil-facing surface 312 to the outer circumferential surface.

The core holding portion 453 holds the corner portion between the coil-facing surface 312 and the coil-facing surface 313. A thickness t5 from the coil-facing surface 312 to the outer circumferential surface is smaller than a thickness t6 from the coil-facing surface 313 to the outer circumferential surface.

The core holding portion 454 holds the corner portion between the coil-facing surface 313 and the coil-facing surface 314. A thickness t7 from the coil-facing surface 313 to the outer circumferential surface is smaller than a thickness t8 from the coil-facing surface 314 to the outer circumferential surface.

The thicknesses satisfy: t1=t8>t7=t6>t5=t4>t3=t2. Note that the thicknesses t1, t6, t7, and t8 may also be the same, and the thicknesses t2, t3, t4, and t5 may also be the same. In any case, the thickness of the core holding portion 452 on the displacement direction side is set to be smaller than the thickness of the core holding portion 454 on the side that is opposite the displacement direction side (on the center point Y side when seen from the center point X).

How Intermediate Divisional Piece Holds Core Piece

Figure 7:
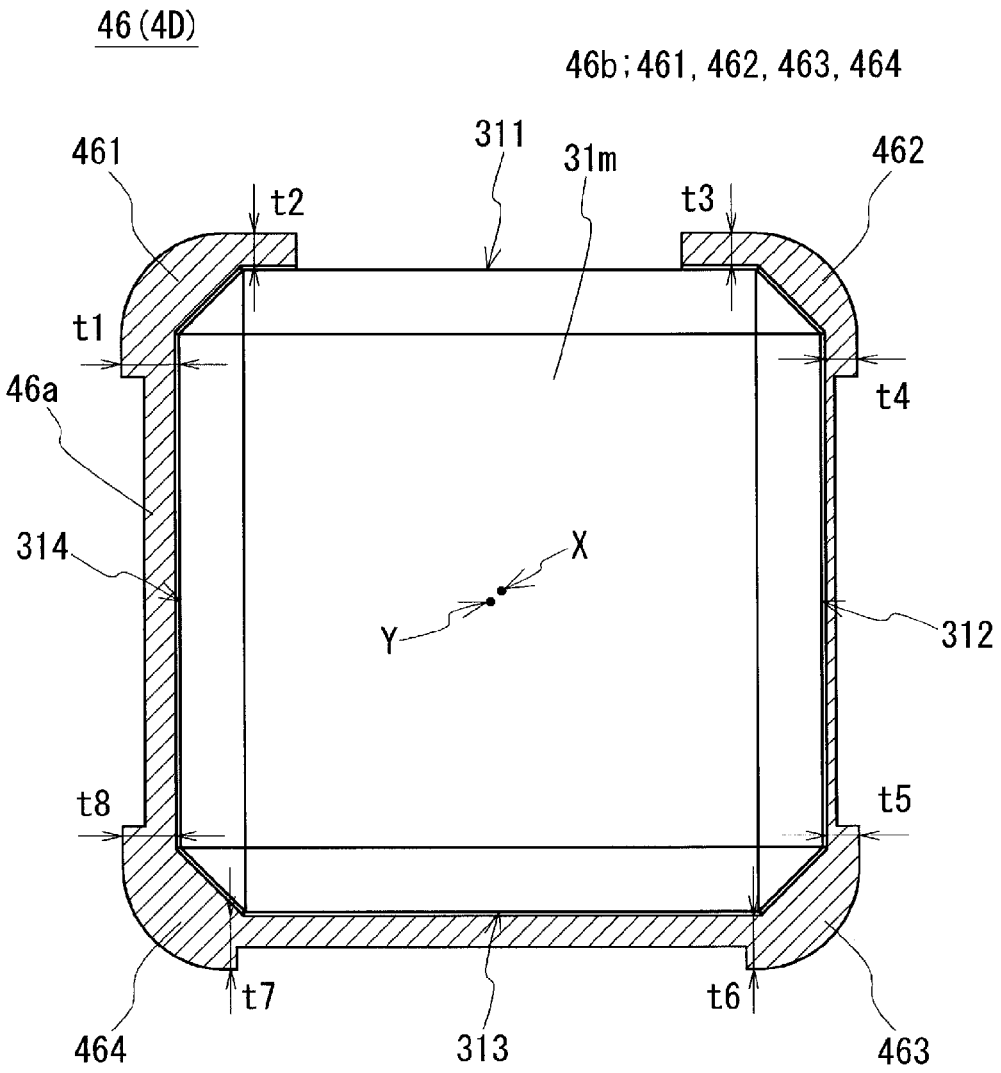
FIG. 7 is a partial cross-sectional view illustrating how a core piece is fitted into an intermediate divisional piece of the inner interposed member.

How the core holding portions 46*b* hold a core piece 31*m* will be described with reference to FIG. 7. FIG. 7 is a partial cross-sectional view of the intermediate divisional pieces 46 on the left in FIG. 5, into which a core piece 31*m* at the center is fitted, and is a view from the intermediate divisional pieces 46 side. In FIG. 7, the core holding portions are assigned reference numerals 461, 462, 463, and 464 in the clockwise direction from the one at the upper left of the drawing sheet.

The core holding portions 461 to 464 are configured as described below. Therefore, as with the core piece 31*m* held by the end portion divisional pieces 45 in FIG. 6, the core piece 31*m* held by the core holding portions 461 to 464 is placed at a position that is decentered toward the top right of the drawing sheet relative to the frame portion 46*a*. The amount of displacement of the core piece 31*m* in a displacement direction (i.e. the distance between the center point X and the center point Y) may be, for example, at least 0.1 mm and at most 1.5 mm, and more preferably at least 0.15 mm and at most 0.7 mm. The amount of displacement of the core piece 31*m* may be the same as, or different from, the amount of displacement of the core piece 31*m* relative to the end portion divisional piece 45 in FIG. 6.

The contour of the cross section of the outer circumferential surface of each of the core holding portions 461 to 464 is constituted by a round portion, which is arc-shaped, and two straight line portions that extend from the ends of the round portion. In this example, one of the straight line portions is orthogonal to the other of the straight line portions.

The contours of the inner circumferential surfaces of the core holding portions 461 to 464 have a shape that matches the contours of the corner portions of the core piece 31*m*.

The core holding portion 461 holds the corner portion between the coil-facing surface 311 and the coil-facing surface 314. A thickness t1 from the coil-facing surface 314 to the outer circumferential surface (a straight line portion) is greater than a thickness t2 from the coil-facing surface 311 to the outer circumferential surface.

The core holding portion 462 holds the corner portion between the coil-facing surface 311 and the coil-facing surface 312. A thickness t3 from the coil-facing surface 311 to the outer circumferential surface is smaller than a thickness t4 from the coil-facing surface 312 to the outer circumferential surface.

The core holding portion 463 holds the corner portion between the coil-facing surface 312 and the coil-facing surface 313. A thickness t5 from the coil-facing surface 312 to the outer circumferential surface is smaller than a thickness t6 from the coil-facing surface 313 to the outer circumferential surface.

The core holding portion 464 holds the corner portion between the coil-facing surface 313 and the coil-facing surface 314. A thickness t7 from the coil-facing surface 313 to the outer circumferential surface is smaller than a thickness t8 from the coil-facing surface 314 to the outer circumferential surface.

The thicknesses satisfy: t1=t8>t7=t6>t5=t4>t3=t2. Note that the thicknesses t1, t6, t7, and t8 may be the same, and the thicknesses t2, t3, t4, and t5 may be the same. In any case, the thickness of the core holding portion 462 on the displacement direction side is set to be smaller than the thickness of the core holding portion 464 on the side that is opposite the displacement direction side (on the center point Y side when seen from the center point X).

Arrangement of Inner Core Portions in Winding Portions

Figure 8:
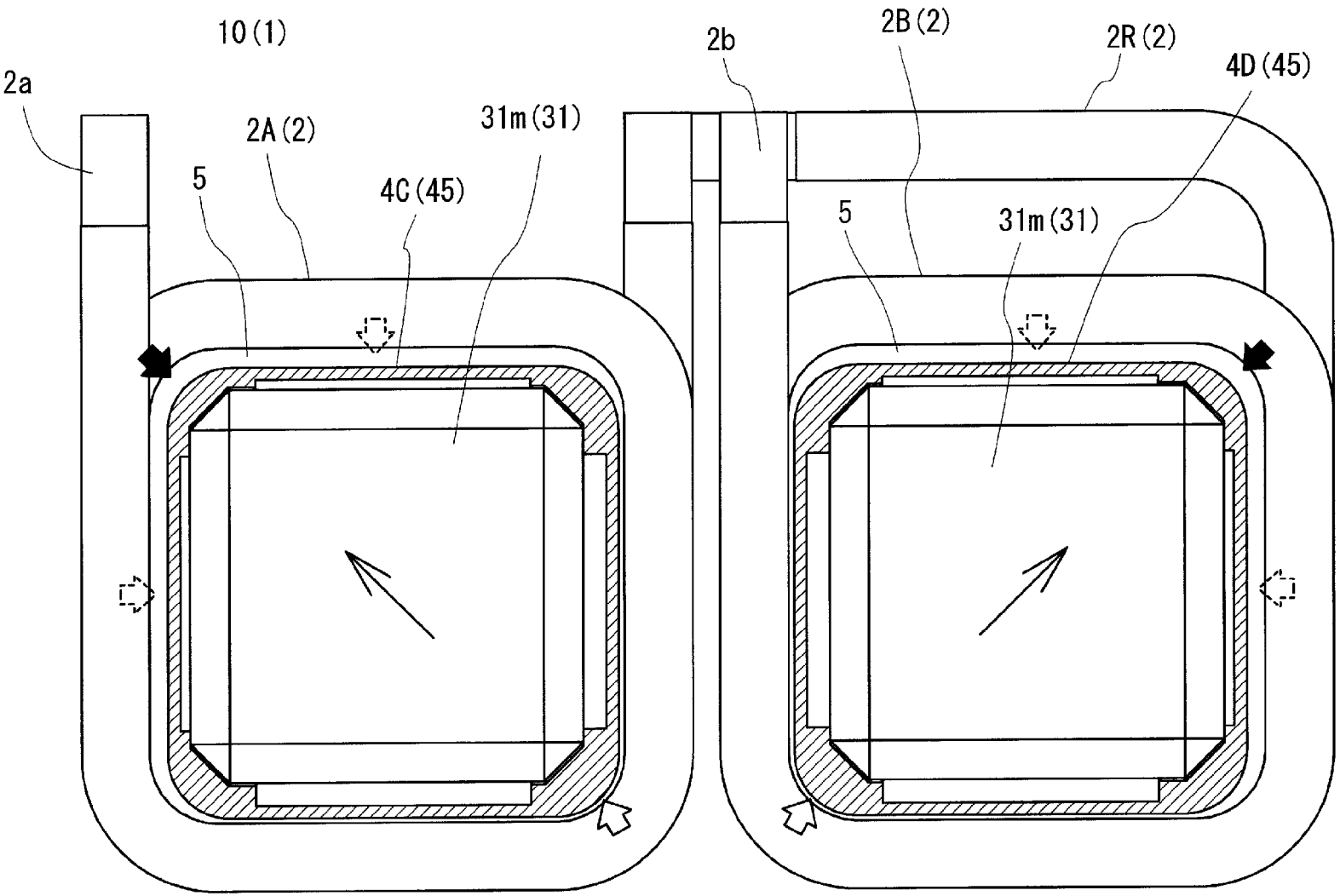
FIG. 8 is a partial cross-sectional view illustrating how divisional pieces and core pieces are arranged inside the winding portions of the coil.

How core piece 31*m* are arranged in the winding portions 2A and 2B will be described with reference to FIG. 8. FIG. 8 is a partial cross-sectional view showing the arrangement of the core pieces 31*m* held by the end portion divisional pieces 45 in the winding portions 2A and 2B, seen from the same direction as in FIG. 4. That is, the resin filling holes h1 in FIG. 4 are open at positions that are indicated by dotted arrows. Although not illustrated in this example, the arrangement of the core pieces 31*m* held by the intermediate divisional pieces 46 (see FIG. 7) is the same as that in FIG. 8.

As shown in FIG. 8, in the reactor 1 in this example, the core pieces 31*m* arranged in the winding portions 2A and 2B of the coil 2 are held by the end portion divisional pieces 45. The core pieces 31*m* are held at positions that are decentered in the directions (displacement directions) indicated by the solid arrows in the divisional pieces 45. The separation distance (see the filled arrows) between the inner circumferential surfaces of the winding portions 2A and 2B and the outer circumferential surfaces of the end portion divisional pieces 45 on the displacement direction side of the core pieces 31*m* is greater than the separation distance (the outline arrows) between the inner circumferential surfaces of the winding portions 2A and 2B and the outer circumferential surfaces of the end portion divisional pieces 45 on the side that is opposite the displacement direction side. That is, the divisional pieces 45 that hold the core pieces 31*m* are displaced away from the displacement direction side of the core pieces 31*m* in the winding portions 2A and 2B, and as a result, the center points of the core pieces 31*m* seen in the axial direction of the winding portions 2A and 2B are positioned close to the center points of the winding portions 2A and 2B.

Effects of Reactor

As shown in FIG. 8, in the reactor 1 in this example, the core pieces 31*m* that constitute the inner core portions 31 are arranged at approximately the centers of the internal spaces of the winding portions 2A and 2B. Therefore, variation in the thickness of the inner resin portions 5 located between the inner circumferential surfaces of the winding portions 2A and 2B and the outer circumferential surfaces of the inner core portions 31 is small, and the inner resin portions 5 are less likely to be damaged due to, for example, vibrations occurring during the use of the reactor 1. Note that the thickness of the inner resin portions 5 between the inner circumferential surfaces of the winding portions 2A and 2B and the outer circumferential surfaces of the inner interposed members 4C and 4D is not uniform, but such nonuniformity hardly degrades the strength of the inner resin portions 5. This is because, as shown in FIG. 3, the inner interposed members 4C and 4D only cover small portions of the outer circumferential surfaces of the inner core portions 31.

Also, in the reactor 1 in this example, the outer circumferential surfaces of the winding portions 2A and 2B of the coil 2 are not covered by molded resin, and are directly exposed to the external environment. Therefore, the reactor 1 in this example has excellent heat dissipation properties. If the combined body 10 of the reactor 1 is immersed in a liquid refrigerant, the heat dissipation properties of the reactor 1 can be further improved.

Use

The reactor 1 in this example can be used as a constituent member of a power converter device such as a bidirectional DC-DC converter that is mounted on an electrical vehicle such as a hybrid vehicle, an electrical vehicle, or a fuel cell vehicle.

Method for Manufacturing Reactor

Next, the following describes an example of a reactor manufacturing method for manufacturing the reactor 1 according to the first embodiment. Generally, the reactor manufacturing method includes the following steps. The reactor manufacturing method is mainly described with reference to FIGS. 3 to 5, 9, and 10.

Coil Manufacturing Step
Integration Step
Assembly Step
Filling Step
Hardening Step Coil Manufacturing Step In this step, the winding wire 2*w* is prepared, and a portion of the winding wire 2*w* is wound to manufacture the coil 2. A well-known winding machine can be used to wind the winding wire 2*w*. A coating layer that is made of heat-fusing resin, which constitutes the integration resin 20 described with reference to FIG. 2 can be formed on the outer circumferential surface of the winding wire 2*w*. The thickness of the coating layer may be selected as appropriate. If the integration resin 20 is not provided, a winding wire 2*w* without a coating layer can be used, and the following integration step is unnecessary.

Integration Step

In this step, the winding portions 2A and 2B of the coil 2 manufactured in the coil manufacturing step are integrated into one piece using the integration resin 20 (see FIG. 2). If a coating layer that is made of heat-fusing resin is formed on the outer circumferential surface of the winding wire 2*w*, the coil 2 is subjected to thermal treatment, and thus the integration resin 20 can be formed. In contrast, if no coating layer is formed on the outer circumferential surface of the winding wire 2*w*, resin is applied to the outer circumferential surfaces and the inner circumferential surfaces of the winding portions 2A and 2B of the coil 2, the resin is hardened, and thus the integration resin 20 can be formed. This integration step may be performed after the assembly step and before the filling step, which are described below.

Assembly Step

In this step, the coil 2, the core pieces 31*m* and 32*m* that constitute the magnetic core 3, and the insulative interposed member 4 are combined together. For example, as shown in FIG. 3, first assemblies, in which the core pieces 31*m* are arranged in the inner interposed members 4C and 4D, are manufactured, and the first assemblies are disposed in the internal spaces of the winding portions 2A and 2B. Next, the end surface interposed members 4A and 4B are abutted against proximal end surfaces and distal end surfaces of the winding portions 2A and 2B, and are sandwiched between the pair of core pieces 32*m*, and thus a second assembly, which is a combination of the coil 2, the core pieces 31*m* and 32*m*, and the insulative interposed member 4, is manufactured.

Here, as shown in FIG. 4, when the second assembly is seen from the outside of a core piece 32*m* (an outer core portion 32), the resin filling holes h3 that are used to fill the internal spaces of the winding portions 2A and 2B with resin are formed at side edge positions and upper edge positions of the core piece 32*m*. The resin filling holes h1 are constituted by gaps between the core insertion holes 42 (see FIG. 3) of the end surface interposed members 4A and 4B and the outer core portions 32 inserted into the core insertion holes 42.

Filling Step

Figure 9:
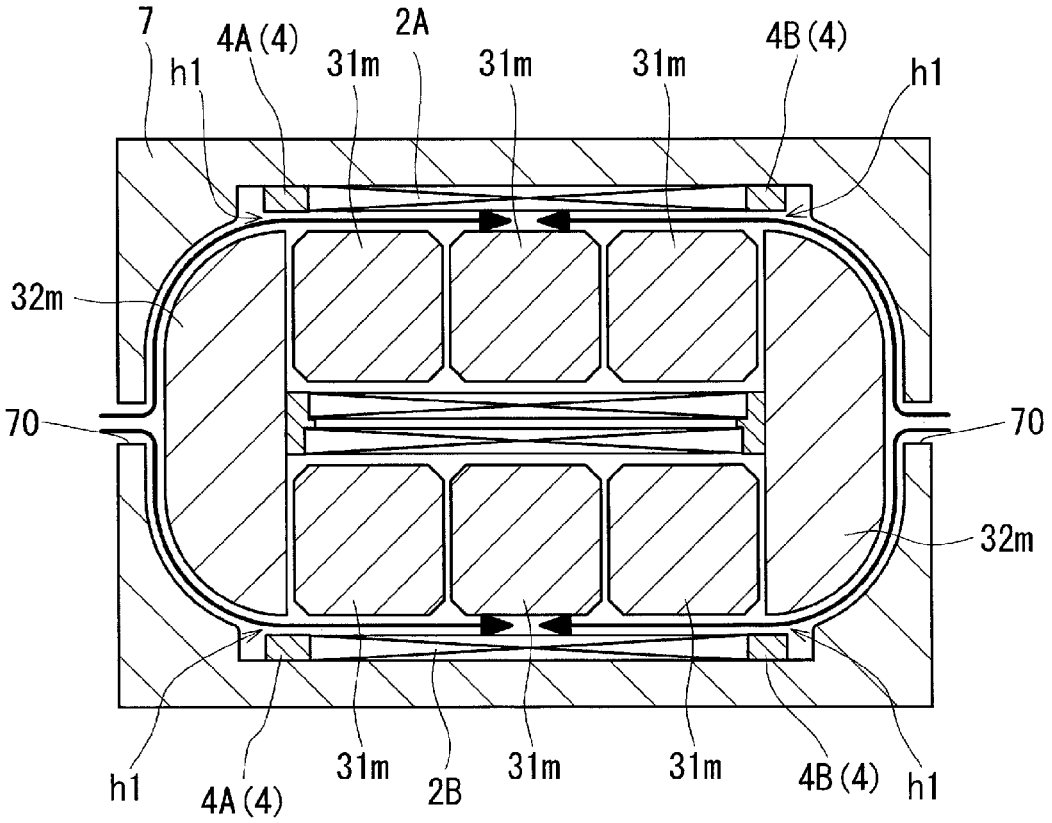
FIG. 9 is a diagram illustrating a method for manufacturing the reactor according to the first embodiment.

In the filling step, the inner spaces of the winding portions 2A and 2B of the second assembly are filled with resin. In this example, as shown in FIG. 9, the second assembly is set in a mold 7, and injection molding is performed, by which resin is injected into the mold 7. FIG. 9 shows a horizontal cross sections of the mold 7 and the second assembly, and the flow of the resin is indicated by black arrows. In FIG. 9, the inner interposed members are omitted.

Resin is injected from two resin injection holes 70 of the mold 7. The resin injection holes 70 are located at positions corresponding to end portions of the core pieces 32*m*, and resin is injected from the outer side of each core piece 32*m* (the side opposite the coil 2). The resin filled into the mold 7 covers the outer circumferential surfaces of the core pieces 32*m*, and flows into the internal spaces of the winding portions 2A and 2B via the resin filling holes h1 (see FIG. 4 also).

Figure 10:
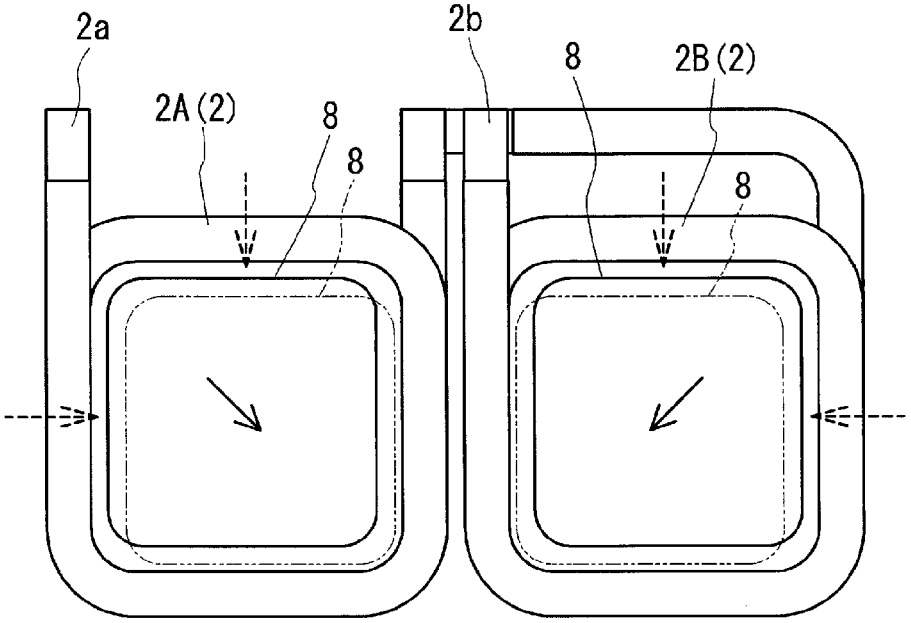
FIG. 10 is a diagram illustrating how first assemblies that are constituted by inner interposed members and core pieces move within the winding portions when the reactor according to the first embodiment is manufactured.

FIG. 10 illustrates movement of first assemblies 8 (each of which is a combination of a core piece and an inner interposed member) when the winding portions 2A and 2B are filled with resin. For the purpose of illustration, FIG. 10 shows a state in which the first assemblies 8 are respectively at the centers of the winding portions 2A and 2B before the winding portions 2A and 2B have been filled with resin. However, in reality, the first assemblies 8 are displaced in certain directions from the centers of the winding portions 2A and 2B due to the influence of gravity. The resin injected from the resin filling holes h1 starts filling the internal spaces of the winding portions 2A and 2B from positions, which are indicated by the dotted arrows, in the opening portions of the end surfaces of the winding portions 2A and 2B in the axial direction. The positions indicated by the dotted arrows are respectively located on the displacement direction side of the core pieces 31*m* indicated by the solid arrows in FIG. 8. The resin spreads around the outer circumferential surfaces of the first assemblies 8 overall. However, pressure from the resin is particularly high at the entrances for the resin, which are indicated by the dotted arrows. Therefore, pressure from the resin is applied to the first assemblies 8 in the directions indicated by the solid arrows, i.e. directions that are substantially opposite to the displacement directions of the core pieces 31*m*. Due to pressure from the resin, the first assemblies 8 are ultimately moved to the positions indicated by the two-dot chain lines, i.e. they are moved in directions that are opposite to the displacement directions in the winding portions 2A and 2B, regardless of the positions of the first assemblies 8 in the winding portions 2A and 2B before the winding portions 2A and 2B are filled with resin. As shown in FIG. 8, the core pieces of the first assemblies 8 that have been moved in the directions that are opposite to the displacement directions are displaced from the centers of the inner interposed members 4C and 4D in the displacement directions, and therefore the core pieces 31*m* are substantially positioned at the centers of the winding portions 2A and 2B.

Also, as shown in FIG. 9, the resin filled into the internal spaces of the winding portions 2A and 2B flows not only into gaps between the inner circumferential surfaces of the winding portions 2A and 2B and the outer circumferential surfaces of the core pieces 31*m*, but also into a gap between two core pieces 31*m* that are adjacent to each other, and a gap between a core piece 31*m* and an outer core portion 32 (a core piece 32*m*), and thus the gap portions 31*g* and 32*g* are formed. Resin that is filled into the internal spaces of the winding portions 2A and 2B at high pressure through injection molding sufficiently fills the narrow gaps between the winding portions 2A and 2B and the inner core portions 31, but hardly leaks out of the winding portions 2A and 2B. This is because, as shown in FIG. 2, the end surfaces of the winding portion 2B in the axial direction and the end surface interposed members 4A and 4B are in surface contact, and the winding portion 2B is formed as an integrated member, using the integration resin 20.

Hardening Step

In the hardening step, the resin is hardened through thermal processing or the like. As shown in FIG. 2, portions of the hardened resin in the internal spaces of the winding portions 2A and 2B constitute the inner resin portions 5, and portions that cover the core pieces 32*m* constitute the outer resin portions 6.

Effects

With the above-described reactor manufacturing method, it is possible to manufacture the combined body 10 of the reactor 1 shown in FIG. 1. Also, with the reactor manufacturing method in this example, the inner resin portions 5 and the outer resin portions 6 are formed integrally with each other, and the filling step and the hardening step only need to be performed once. Therefore, it is possible to manufacture the combined body 10 at high productivity.

Modification 1

As described in the first embodiment, the end portion divisional pieces 45 and the intermediate divisional pieces 46 that constitute the inner interposed members 4C and 4D are asymmetric, where the thicknesses of the core holding portions 451 to 454 and 461 to 464 (FIGS. 6 and 7) are slightly different. That is, there are appropriate directions in which the divisional pieces 45 and 46 can be attached to the winding portions 2A and 2B. For example, if the end portion divisional piece 45 at the right end on the drawing sheet of FIG. 5 is replaced with the end portion divisional piece 45 at the left end on the drawing sheet, or if an intermediate divisional piece 46 horizontally rotated by 180° is attached to a core piece 31*m*, the displacement direction of the core piece 31*m* relative to the inner interposed member 4D will be incorrect. Specifically, as indicated by the solid arrows in FIG. 8, although the core pieces 31*m* are desired to be decentered upward toward the outer sides of the inner interposed members 4C and 4D relative to the parallel directions, the core pieces 31*m* will be decentered upward toward the inner sides relative to the parallel directions. If this is the case, when resin is injected from the positions indicated by the dotted arrows in FIG. 8, the centers of the core pieces 31*m* cannot be positioned at the centers of the winding portions 2A and 2B.

To solve the above-described problem, it is preferable that the end portion divisional pieces 45 and the intermediate divisional pieces 46 are provided with direction determining portions that determine the directions in which they are attached to the winding portions 2A and 2B. The positions at which the direction determining portions are formed and their configurations are not specifically limited as long as they make it possible to visually check the directions in which the divisional pieces 45 and 46 are attached. Examples of the direction determining portions include a mark that is provided on the outer surface of the side that is to be located on the outer side, relative to the parallel directions of the winding portions 2A and 2B, from among the four (three) sides that constitute a frame portion 45*a* (a frame portion 46*a*) of an end portion divisional piece 45 (an intermediate divisional piece 46) shown in FIG. 5. The mark may be painted, or configured as a recess or a protrusion that can be easily seen. Also, the mark may be a graphical symbol such as a triangle or a square, or text such as "outside".

Second Embodiment

Figure 11:
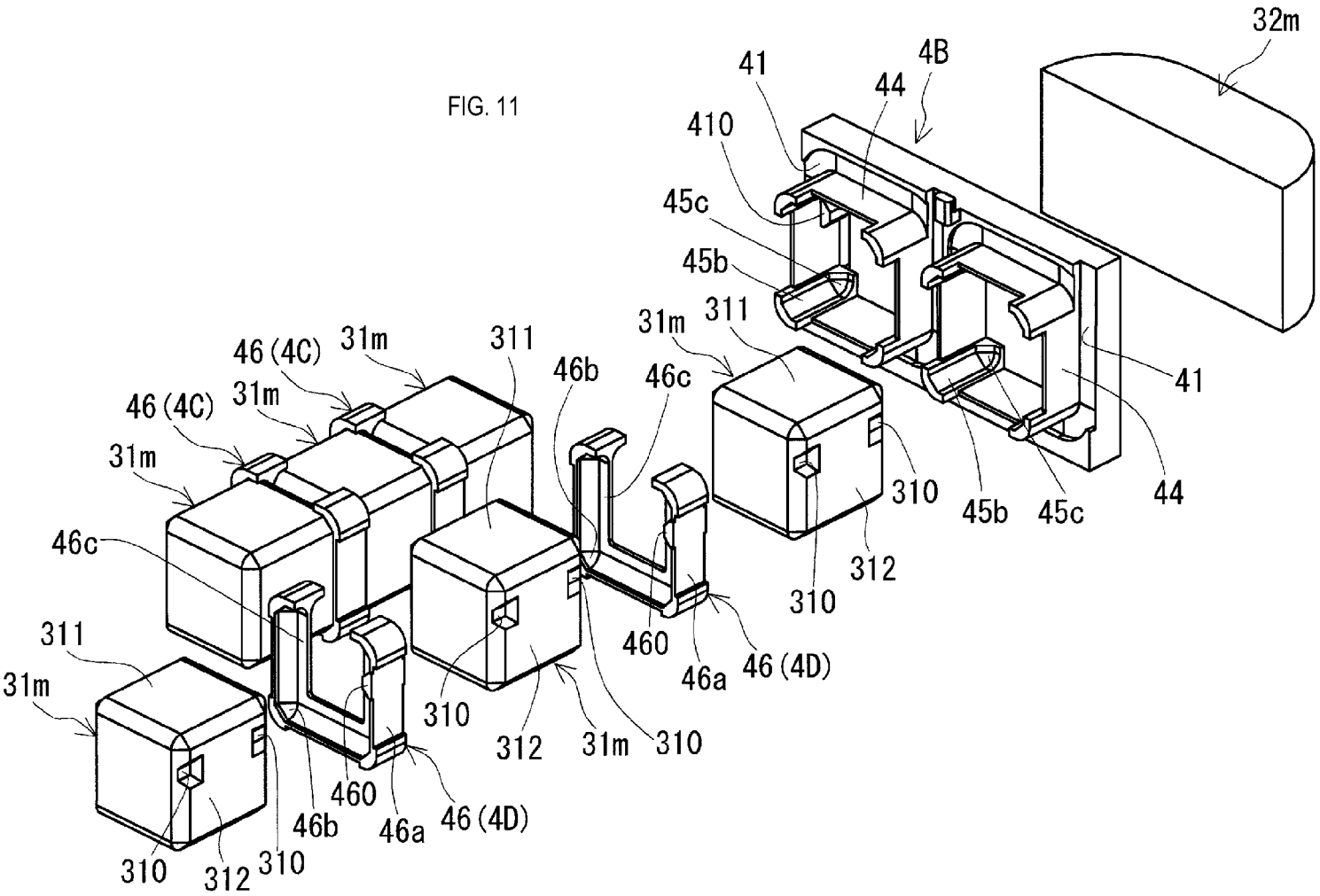
FIG. 11 is an exploded perspective view of a portion of a combined body that is included in the reactor according to the first embodiment.

The second embodiment describes a reactor in which the inner interposed members 4C and 4D are constituted only by intermediate divisional pieces 46, and the end surface interposed members 4A and 4B are provided with the functions of an end portion divisional piece, based on FIG. 11. FIG. 11 only shows the core pieces 31*m* that constitute inner core portions, the inner interposed members 4C and 4D, an end surface interposed member 4B, and a core piece 32*m* that is located outside the end surface interposed member 4B and constitutes an outer core portion. Components that have the same functions as those in the first embodiment are assigned the same reference numerals as in the first embodiment, and descriptions thereof are omitted.

The end surface interposed member 4B in this example is provided with core housing portions 44 that have a frame shape and house core pieces 31*m*. As with the end portion divisional pieces 45 in the first embodiment (FIG. 5), each core housing portion 44 is provided with core holding portions 45*b* that hold a core piece 31*m* at a position that is displaced from the center of the core housing portion 44.

In the reactor in this example, protrusions are respectively provided on the inner surfaces of the outer side, relative to the parallel directions of the winding portions 2A and 2B (FIG. 1), from among the three sides that constitute a frame portion 46*a*, which serve as direction determining portions 460 that prevent the intermediate divisional pieces 46 from being attached in an incorrect direction. The direction determining portions 460 are provided at a proximal position and a distal position in the axial direction of the winding portions 2A and 2B, one at a position, with an abutting portion 46*c* between them. Since the direction determining portion 460 can be easily seen, it possible to almost completely prevent the intermediate divisional pieces 46 from being attached in an incorrect direction. Unlike in the present example, the direction determining portions 460 may also be formed on the inner surface of the inner side, relative to the aforementioned parallel directions. A plurality of direction determining portions 460 may be provided. However, if this is the case, the intermediate divisional pieces 46 are configured to be obviously asymmetrical. Alternatively, the direction determining portions 460 may be recesses.

Here, it is preferable that the direction determining portion 460 is formed at a position that is on the upper side or the lower side of the intermediate divisional piece 46 so that the orientation of the intermediate divisional piece 46 in the vertical direction can be easily discerned. In this example, the direction determining portion 460 is located on the upper side of the intermediate divisional piece 46 relative to the central position in the height direction. In the intermediate divisional piece 46 in this example, the upper side of the frame portion 46*a* is open, and it is unlikely that the upper side and the lower side are mistaken for each other. However, by forming the direction determining portion 460 at a position that is on the upper side or the lower side in the vertical direction, it is possible to make it less likely that the upper side and the lower side are mistaken for each other.

In this example, in addition to the direction determining portions 460 of the intermediate divisional pieces 46, a pair of engaging portions 310 that engage with a direction determining portion 460 is formed in each core piece 31*m* as a component for preventing the intermediate divisional pieces 46 from being attached in an incorrect direction. Each engaging portion 310 is formed as a recess that engages with a direction determining portion 460 having a protruding shape. Engaging portions 310 in this example are provided in a proximal edge and a distal edge of the coil-facing surface 312 of each core piece 31*m* in the axial direction of the winding portions 2A and 2B (FIG. 1). If engaging portions 310 are formed in a core piece 31*m*, the direction in which the core piece 31*m* and an intermediate divisional piece 46 can be attached to each other is physically limited. Therefore, it is easier to attach the core piece 31*m* and the intermediate divisional piece 46 to each other. Here, if the direction determining portions 460 are configured as recesses, the engaging portions 310 are preferably configured as protrusions.

Furthermore, in the reactor in this example, engaging portions 410 that are protrusions and are to be fitted to the engaging portions 310, which are recesses formed in core pieces 31*m*, are formed on the inner surface of the core housing portion 44 of the end surface interposed member 4B. Due to the protruding engaging portions 410 being formed, the direction in which core pieces 31*m* are attached to the end surface interposed member 4B is physically limited. Therefore, it is possible to prevent the core pieces 31*m* and the inner interposed members 4C and 4D from being attached to the winding portions 2A and 2B in an incorrect direction. Note that the end surface interposed member 4B houses the turn-housing portions 41 and so on, and the end surface interposed member 4B is obviously asymmetrical. Therefore, it is unlikely that the end surface interposed members 4A and 4B are attached to the winding portions 2A and 2B in an incorrect direction.

Third Embodiment

Figure 12:
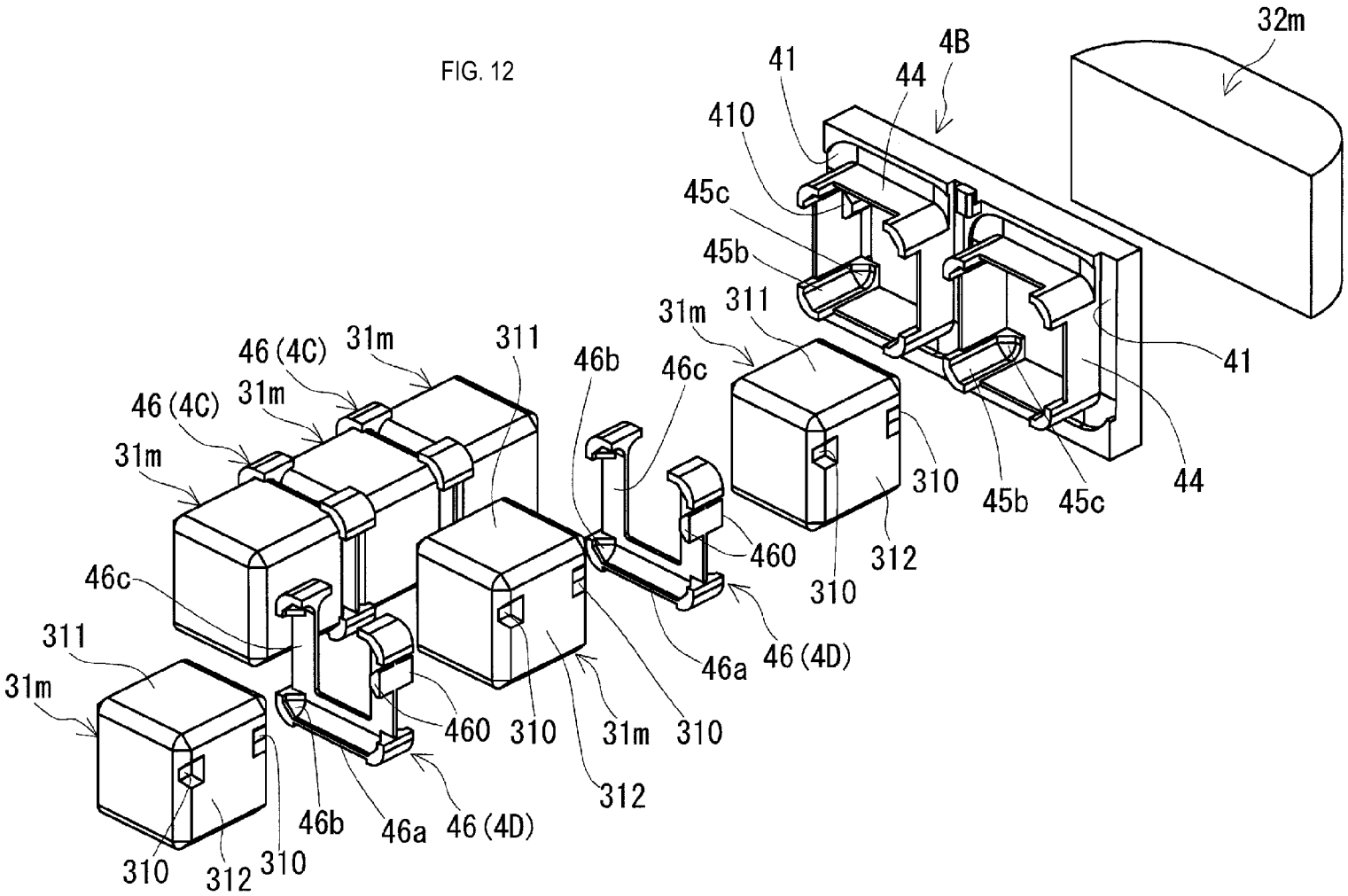
FIG. 12 is an exploded perspective view of a portion of a combined body that is included in a reactor according to a third embodiment.

The third embodiment describes a reactor in which the configurations of the intermediate divisional pieces 46 are different from those in the second embodiment, based on FIG. 12. FIG. 12 only shows the core pieces 31*m*, the inner interposed members 4C and 4D, an end surface interposed member 4B, and the core pieces 32*m*. Components that have the same functions as those in the second embodiment are assigned the same reference numerals as in the second embodiment, and descriptions thereof are omitted.

Each intermediate divisional piece 46 in this example has a configuration in which portions of the frame portion 46*a*, the portions covering the left and right coil-facing surfaces 312 and 314 (see FIG. 7 for 314) of a core piece 31*m*, are omitted from the intermediate divisional piece 46 according to the second embodiment shown in FIG. 11. As shown on the upper left side of FIG. 12, when such an intermediate divisional piece 46 is combined with core pieces 31*m*, three sides (the upper side, the left side, and the right side) of the gap between the core pieces 31*m* that are adjacent to each other are not covered by the frame portion 46*a* and are exposed to the outside. Therefore, when filling the internal spaces of the winding portions 2A and 2B (FIG. 1) with resin, the resin easily fills the gap between core pieces 31*m* that are adjacent to each other, and it is less likely that an empty space is formed in the gap portion.

Fourth Embodiment

As shown in FIG. 4, the first embodiment describes an embodiment in which the resin filling holes h1 are formed at both side edge positions and upper edge positions of the core piece 32*m*. However, the resin filling holes h1 may also be formed only at both side edge positions of the outer core portion 32 shown in FIG. 4. If this is the case, in FIG. 6 (FIG. 7), the thickness of the core holding portions 451 to 454 (461 to 464) of the end portion divisional pieces 45 (the intermediate divisional pieces 46) may be adjusted such that the core pieces 31*m* are decentered toward the right side of the drawing sheet. With such a configuration, as shown in FIG. 9, the core pieces 31*m* can be substantially located at the central positions of the winding portions 2A and 2B when the internal spaces of the winding portions 2A and 2B are filed with resin.

Alternatively, the resin filling holes h1 may be formed only at upper side edge positions of the outer core portion 32 shown in FIG. 4. If this is the case, in FIG. 6 (FIG. 7), the thickness of the core holding portions 451 to 454 (461 to 464) of the end portion divisional pieces 45 (the intermediate divisional pieces 46) may be adjusted such that the core pieces 31*m* are decentered toward the upper side of the drawing sheet.

Fifth Embodiment

In the above-described embodiments, each of the inner interposed members 4C and 4D are constituted by a plurality of divisional pieces 45 and 46. However, each of the inner interposed members 4C and 4D may also be constituted by a single member. If this is the case, the inner interposed members 4C and 4D may be formed so as to have a basket shape, for example, and core pieces 31*m* may be housed in the inner interposed members 4C and 4D.

Sixth Embodiment

The combined body 10 according to the above-described embodiments may be housed in a casing, and the combined body 10 may be embedded in the casing using potting resin. For example, the second assembly manufactured through the assembly step according to the reactor manufacturing method according to the first embodiment is housed in a casing, and the casing is filled with potting resin. If this is the case, portions of potting resin that surround the outer circumferential surfaces of the core pieces 32*m* (the outer core portions 32) constitute the outer resin portions 6. Also, portions of potting resin that flow into the winding portions 2A and 2B via the resin filling holes h1 of the end surface interposed members 4A and 4B constitute the inner resin portions 5.

The invention claimed is:

1. A reactor comprising:

a coil that includes a winding portion;

a magnetic core that includes an inner core portion located inside the winding portion and an outer core portion located outside the winding portion; and an inner interposed member that is interposed between the inner circumferential surface of the winding portion and the outer circumferential surface of the inner core portion, wherein the inner core portion includes a plurality of core pieces that are separate from each other, the reactor further comprises an inner resin portion that fills a gap between the inner circumferential surface of the winding portion and the outer circumferential surface of the inner core portion, the inner interposed member is provided with core holding portions that hold the core pieces at positions that are decentered relative to the inner interposed member when seen in an axial direction of the winding portion, and when a direction from a center point of the inner interposed member to the center points of the core pieces seen in the axial direction of the winding portion is defined as a displacement direction, a separation distance between the inner circumferential surface of the winding portion and the outer circumferential surface of the inner interposed member on the displacement direction side is longer than a separation distance between the inner circumferential surface of the winding portion and the outer circumferential surface of the inner interposed member on the side that is opposite the displacement direction side.

2. The reactor according to claim 1, wherein the inner interposed member includes a plurality of divisional pieces that are arranged in the axial direction of the winding portion and are separate from each other, and each divisional piece includes a frame portion that houses an end portion, in the axial direction, of a core piece, and the core holding portions that are provided integrally with the frame portion.

3. The reactor according to claim 1, wherein each core piece has a rectangular parallelepiped shape with four coil-facing surfaces that face the inner circumferential surface of the winding portion, the inner interposed member is provided with core holding portions that support corner portions of two coil-facing surfaces that are adjacent to each other, and a thickness of a core holding portion located on the displacement direction side is smaller than the thickness of a core holding portion on the side that is opposite the displacement direction side.

4. The reactor according to claim 1, further comprising:

an end surface interposed member that is interposed between an end surface of the winding portion in the axial direction and the outer core portion, wherein the end surface interposed member is provided with a resin filling hole that is used to fill an internal space of the winding portion with resin that constitutes the inner resin portion, from the outer core portion side, and the resin filling hole is located on the displacement direction side when the end surface interposed member is seen in the axial direction of the winding portion.

5. The reactor according to claim 4, further comprising:

an outer resin portion that integrates the outer core portion with the end surface interposed member, and wherein the outer resin portion and the inner resin portion are connected to each other via the resin filling hole.

6. The reactor according to claim 1, wherein the inner core portion includes the plurality of core pieces and the inner resin portion that fills gaps between core pieces that are adjacent to each other in the axial direction of the winding portion.

7. The reactor according to claim 1, wherein the coil includes an integration resin that is separate from the inner resin portion and integrates turns of the winding portion into one piece.

8. The reactor according to claim 1, wherein the inner interposed member is provided with a direction determining portion that determines a direction in which the inner interposed member is attached to the winding portion.

9. The reactor according to claim 8, wherein the direction determining portion is configured as a protrusion or a recess provided on/in the inner circumferential surface of the inner interposed member, and each core piece is provided with an engaging portion that is a protrusion or a recess that engages with the direction determining portion.

10. A reactor manufacturing method comprising: an assembly step that is a step of attaching a magnetic core to a coil that includes a winding portion; and a filling step that is a step of filling an internal space of the winding portion with resin, wherein the reactor is the reactor according to claim 1, in the assembly step, a first assembly in which the core pieces are held by the inner interposed member is disposed in the internal space of the winding portion, and in the filling step, the winding portion is filled with the resin from a displacement direction-side position in an opening portion of an end surface of the winding portion in the axial direction of the winding portion, and thus the first assembly is displaced in a direction that is opposite to the displacement direction.

* * * * *